US008967998B2

(12) United States Patent
Filius

(10) Patent No.: US 8,967,998 B2
(45) Date of Patent: Mar. 3, 2015

(54) ROTARY KILN LINING AND METHOD

(75) Inventor: Joel R. Filius, York, PA (US)

(73) Assignee: Magnesita Refractories Company, York, PA (US)

( * ) Notice: Subject to any disclaimer, the term of this patent is extended or adjusted under 35 U.S.C. 154(b) by 788 days.

(21) Appl. No.: 13/101,642

(22) Filed: May 5, 2011

(65) Prior Publication Data

US 2012/0282563 A1 Nov. 8, 2012

(51) Int. Cl.
*F27B 7/28* (2006.01)
*F27D 1/00* (2006.01)

(52) U.S. Cl.
CPC ..... *F27B 7/28* (2013.01); *F27D 1/0006* (2013.01)
USPC ..... 432/119; 241/181

(58) Field of Classification Search
CPC ..... F27B 7/162
USPC ..... 432/118, 119; 241/181, 183; 366/222, 366/228
See application file for complete search history.

(56) References Cited

U.S. PATENT DOCUMENTS

| | | | | |
|---|---|---|---|---|
| 1,205,056 A | | 11/1916 | Stowe | |
| 1,400,087 A | | 12/1921 | Newberry | |
| 1,527,347 A | | 2/1925 | Browne | |
| 2,258,518 A | * | 10/1941 | Seovron | 366/228 |
| 2,703,445 A | | 3/1955 | Veale | |
| 2,829,877 A | | 4/1958 | Davis | |
| 3,196,193 A | | 7/1965 | Davies | |
| 3,298,840 A | | 1/1967 | Campbell | |
| 3,362,698 A | | 1/1968 | Cerny | |
| 3,445,099 A | | 5/1969 | Olsen | |
| 3,592,454 A | * | 7/1971 | Olsen | 432/3 |

(Continued)

FOREIGN PATENT DOCUMENTS

| | | |
|---|---|---|
| DE | 3523723 | 1/1987 |
| GB | 156447 | 1/1921 |

(Continued)

OTHER PUBLICATIONS

Abstract of Agath, H., "Refractory linings in large plants in the cement industry," Zem.-Kalk-Gips. vol. 29, No. 7, pp. 313-17 (1976).

(Continued)

*Primary Examiner* — Gregory A Wilson
(74) *Attorney, Agent, or Firm* — RatnerPrestia

(57) ABSTRACT

Provided is a rotary kiln having a cylindrical shell having an inner cylindrical surface and a longitudinal axis and a kiln lining disposed on the inner cylindrical surface of the shell. The kiln lining includes one or more radial portions of a first size of shaped refractory material disposed on the inner cylindrical surface of the shell along the longitudinal axis for at least a portion of the shell and one or more lifter sections comprising a second size of shaped refractory material that extend along the longitudinal axis for at least a portion of the shell and are between radial portions of the first size of shaped refractory material, wherein the second size of shaped refractory material is greater than the first size of shaped refractory material, such that the second size of shaped refractory material extends orthogonally from the inner cylindrical surface for a greater portion of the diameter of the shell than the first size of shaped refractory material, the second size of shaped refractory materials thereby forming a series of blunt faces. Also included are methods of processing materials using the inventive kiln lining, and methods of assembling the inventive kiln lining.

15 Claims, 5 Drawing Sheets

(56) References Cited

U.S. PATENT DOCUMENTS

| | | | | | |
|---|---|---|---|---|---|
| 4,266,931 | A | * | 5/1981 | Struckmann | 432/105 |
| 4,289,479 | A | | 9/1981 | Johnson, Jr. | |
| 4,624,634 | A | * | 11/1986 | Pettersson et al. | 432/17 |
| 4,729,974 | A | | 3/1988 | Nazirizadeh | |
| 4,952,147 | A | * | 8/1990 | Boyden et al. | 432/103 |
| 5,330,351 | A | * | 7/1994 | Ransom et al. | 432/103 |
| 5,460,518 | A | | 10/1995 | Mosci | |
| 5,702,247 | A | | 12/1997 | Schoof | |
| 5,752,665 | A | * | 5/1998 | Wason | 241/299 |
| 5,873,714 | A | | 2/1999 | Mosci | |
| 5,950,944 | A | * | 9/1999 | Larsen | 241/183 |
| 6,688,884 | B2 | * | 2/2004 | Thibault et al. | 432/118 |
| 6,802,709 | B1 | | 10/2004 | Mosci | |

FOREIGN PATENT DOCUMENTS

| | | |
|---|---|---|
| GB | 482340 | 3/1938 |
| GB | 945640 | 1/1964 |
| GB | 981686 | 1/1965 |
| GB | 1129384 | 10/1968 |
| GB | 1177999 | 1/1970 |
| JP | 2302359 | 12/1990 |
| JP | 2302582 | 12/1990 |
| JP | 5248767 | 9/1993 |
| JP | 6128023 | 5/1994 |
| JP | 7061856 | 3/1995 |
| JP | 9142899 | 6/1997 |
| JP | 11264672 | 9/1999 |
| JP | 2004250313 | 9/2004 |
| JP | 2007285573 | 11/2007 |
| WO | 2009127741 | 10/2009 |

OTHER PUBLICATIONS

Abstract of Arai, M. et al., "Study on Magnesia-Clinker in Bricks for Cement Rotary Kiln Cement Coating Property of Magnesia-Chrome Brick," Refractories (Tokyo), vol. 47, No. 12, pp. 587-588 (1995).

Abstract of Kajita, Y. et al., "Present and Future of Chrome-Free Lining for Rotary Cement Kiln," Refractories (Tokyo), vol. 52, No. 4, pp. 201-206 (2000).

Abstract of Ozeki, F. et al., "Chrome-Free Basic Brick Lining for Cement Rotary Kiln," Refractories (Tokyo), vol. 51, No. 10, pp. 542-549 (1999).

Contreras, J. E. et al., "Microstructure and properties of hercynite-magnesia-calcium zirconate refractory mixtures," Materials Characterization, vol. 54, Issues 4-5, May 2005, pp. 354-359.

Ghosh, A. et al., "Effect of spinel content on the properties of magnesia-spinel composite refractory," Journal of the European Ceramic Society, vol. 24, pp. 2079-2085 (2004).

Itoh, K. et al., "Recent Trends in Cement Kiln Refractories," Shinagawa Technical Report, vol. 43, pp. 45-58 (2000).

* cited by examiner

16

ROTARY KILN LINING AND METHOD

FIELD OF INVENTION

The field of invention relates to rotary kilns, and more particularly to a rotary kiln having an improved lining.

BACKGROUND

Rotary kilns are employed to pyro-process materials such as lime, cement, clinker, alumina, and other calcined or burned products. Conventional rotary kilns include a refractory lining of brick or monolithic casting. The refractory lining protects the outer shell against deterioration due to the extreme temperatures at which pyro-processing occurs, while concurrently mitigating heat loss through the outer metallic shell of the rotary kiln. Artisans have long constructed refractory linings for rotary kilns comprised of refractory bricks or blocks of uniform shape by successively laying these shapes according to methods well known. The VDZ and ISO schedules teach the shapes known in the art for rotary kiln applications, which include wedges, arches, keys and other designs.

Conventional rotary kilns may also include a lifter section, arranged parallel to the length of the kiln, which agitates the material passing through the kiln. Lifters cause this desirable agitation by capturing a portion of the material upon rotation of the kiln, carrying it upwards along the wall of the kiln before releasing it as the lifter rotates towards the uppermost point of rotation. As the material falls off the lifter and towards the lowest point of rotation, it passes through the hot gases existing in the kiln. Thus, as a consequence of increasing agitation, the lifter section enhances the heat transfer from the rotary kiln to the material so processed.

Prior art designs of rotary kilns linings have included lifter sections comprising a single brick attached to the inner shell by way of metal rods and installed for a certain portion of the length of the overall kiln. More recent designs include lifter sections formed of monolithic castings of refractory material. These inflexible prior art designs require specific set-up procedures to ensure the survivability of the base material which, in general, limit the application to the cooler regions of the rotary kiln where the effectiveness as a heat transfer system is minimized. Put another way, prior art designs have generally excluded lifter sections from the hottest portion of the kiln, known as the burning zone, because the extreme temperature and compressive forces of the processed material adversely affect the integrity of the structure. This exclusion, however, causes wasteful heat loss as it prevents sufficient agitation as the material traverses this portion of the rotary kiln. Also, because the burning zone is typically located at or towards the discharge end of the rotary kiln, the material may exit these prior art kilns with less than a sufficient degree of mixing.

SUMMARY OF INVENTION

The present invention identifies and overcomes multiple deficiencies of the prior art. As stated above, the prior art lifter designs can not be implemented in the hottest portions of the kiln. Moreover, monolithic castings prove costly and difficult to repair should only a portion of the casting degrade with use. It has now been identified that, by combining refractory shapes from the steel industry with conventional rotary kiln refractory shapes, a rotary kiln lining and lifter design can be assembled. In particular, the present invention employs refractory shapes known to the steel industry in the lifter section of the inventive kiln lining. These refractory shapes, never before used in rotary kiln applications, form lifter sections that are durable and effective even in the highest temperature zones of the rotary kiln. Embodiments of the present invention desirably agitate the material passing over the inventive kiln lining, resulting in a flexible and cost efficient solution for a kiln of any diameter.

In a first embodiment, a rotary kiln is described that has a cylindrical shell having an inner cylindrical surface and a longitudinal axis. The kiln also includes a kiln lining disposed on the inner cylindrical surface of the shell. The kiln lining generally includes one or more radial portions of a first size of shaped refractory material disposed on the inner cylindrical surface of the shell along the longitudinal axis for at least a portion of the shell. One or more lifter sections comprising a second size of shaped refractory material that extend along the longitudinal axis for at least a portion of the shell separate the one or more radial portions of the first size of shaped refractory material. The second size of shaped refractory material extends orthogonally from the inner cylindrical surface for a greater portion of the diameter of the shell than the first size of shaped refractory material. In this manner, the second size of shaped refractory materials forms a series of blunt faces. The compressive forces resulting from this arrangement assists in maintaining the position of the lifter sections.

The one or more lifter sections may alternatively comprise multiple sizes of shaped refractory material, each greater than the first size of shaped refractory material. These multiple sizes of shaped refractory materials are arranged in a tiered configuration such that the orthogonal height of the shaped refractory material ascends from the outermost shaped refractory material to the innermost refractory material.

The inventive rotary kiln may include one, two, or more lifter sections. In a preferred embodiment, the lifter sections run along the longitudinal axis of the shell for at least the burning zone portion of the shell. In order to withstand the extreme conditions of the burning zone portion of the shell, the shaped materials of the lifter sections are preferably comprised of materials such as: between about 58 to about 95 percent by weight MgO; between about 1 to about 39 percent by weight CaO; between about 0.5 to about 3 percent by weight $ZrO_2$; between about 0.5 to about 2 percent by weight $SiO_2$; between about 0.1 to about 1.5 percent by weight $Al_2O_3$; and between about 0 to about 1 percent by weight $Fe_2O_3$.

In another embodiment, a method is provided for processing materials in a rotary kiln. The method includes feeding a burden of material to be processed into a processing zone. The processing zone comprises a cylindrical shell having an inner cylindrical surface and a longitudinal axis. One or more radial arrangements of a first size of shaped refractory materials are disposed on the inner cylindrical surface of the shell arranged along the longitudinal axis for at least a portion of the shell. One or more lifter sections comprised of a second size of shaped refractory materials extend along the longitudinal axis for at least a portion of the shell and act to separate the radial arrangements of the first size of shaped refractory materials. The second size of shaped refractory materials extends orthogonally from the inner cylindrical surface for a greater portion of the diameter of the shell than the first size of shaped refractory materials. In this manner, the second size of shaped refractory materials forms a series of blunt faces that extend above the radial arrangements of the first size of shaped refractory materials. Next, the processing zone is rotated such that the blunt faces lift the material along the wall of the processing zone. In a preferred embodiment, the processing zone is located in the burning zone portion of the rotary kiln.

The processing zone may comprise more than one lifter section. Further, the compressive forces resulting from the cylindrical configuration can maintain the positioning of the lifter sections. In some embodiments of the present invention, the lifter section of the processing zone comprises multiple sizes of shaped refractory materials, each extends orthogonally from the inner cylindrical surface for a greater portion of the diameter of the shell than the first size of shaped refractory materials. The multiple sizes of shaped refractory materials are arranged in a tiered configuration such that the orthogonal height of the shaped refractory materials ascends from the outermost shaped refractory materials to the innermost refractory materials. The shaped materials of the lifter sections are preferably comprised of materials such as: between about 58 to about 95 percent by weight MgO; between about 1 to about 39 percent by weight CaO; between about 0.5 to about 3 percent by weight $ZrO_2$; between about 0.5 to about 2 percent by weight $SiO_2$; between about 0.1 to about 1.5 percent by weight $Al_2O_3$; and between about 0 to about 1 percent by weight $Fe_2O_3$.

Yet another embodiment includes a method of assembling a kiln lining comprised of a substantially horizontally-oriented cylindrical shell having an inner cylindrical surface and a longitudinal axis. First, one or more radial arrangements of a first size of shaped refractory materials are disposed on the inner cylindrical surface of the shell along the longitudinal axis for at least a portion of the shell. Second, one or more lifter sections comprising a second size of shaped refractory materials that extend along the longitudinal axis for at least a portion of the shell are placed between radial arrangements of the first size of shaped refractory materials. The second size of shaped refractory materials extends orthogonally from the inner cylindrical surface for a greater portion of the diameter of the shell than the first size of shaped refractory materials. The second size of shaped refractory materials thereby form a series of blunt faces on the inner surface of the kiln lining.

The inventive kiln lining, while not limited in location, is preferably located at least in the burning zone portion of the kiln. In an exemplary embodiment, the kiln lining may comprise more than one lifter section. Further, the compressive forces resulting from the cylindrical configuration can maintain the positioning of the lifter sections. In some embodiments of the present invention, the lifter section of the kiln lining comprises multiple sizes of shaped refractory materials, each greater than the first size of shaped refractory materials and arranged in a tiered configuration such that the orthogonal height of the shaped refractory materials ascends from the outermost shaped refractory materials to the innermost refractory materials. The shaped materials of the lifter sections are preferably comprised of materials such as: between about 58 to about 95 percent by weight MgO; between about 1 to about 39 percent by weight CaO; between about 0.5 to about 3 percent by weight $ZrO_2$; between about 0.5 to about 2 percent by weight $SiO_2$; between about 0.1 to about 1.5 percent by weight $Al_2O_3$; and between about 0 to about 1 percent by weight $Fe_2O_3$.

It is understood that the foregoing general description and the following detailed description are exemplary, but are not restrictive, of the invention.

DETAILED DESCRIPTION OF THE INVENTION

Figure 1:
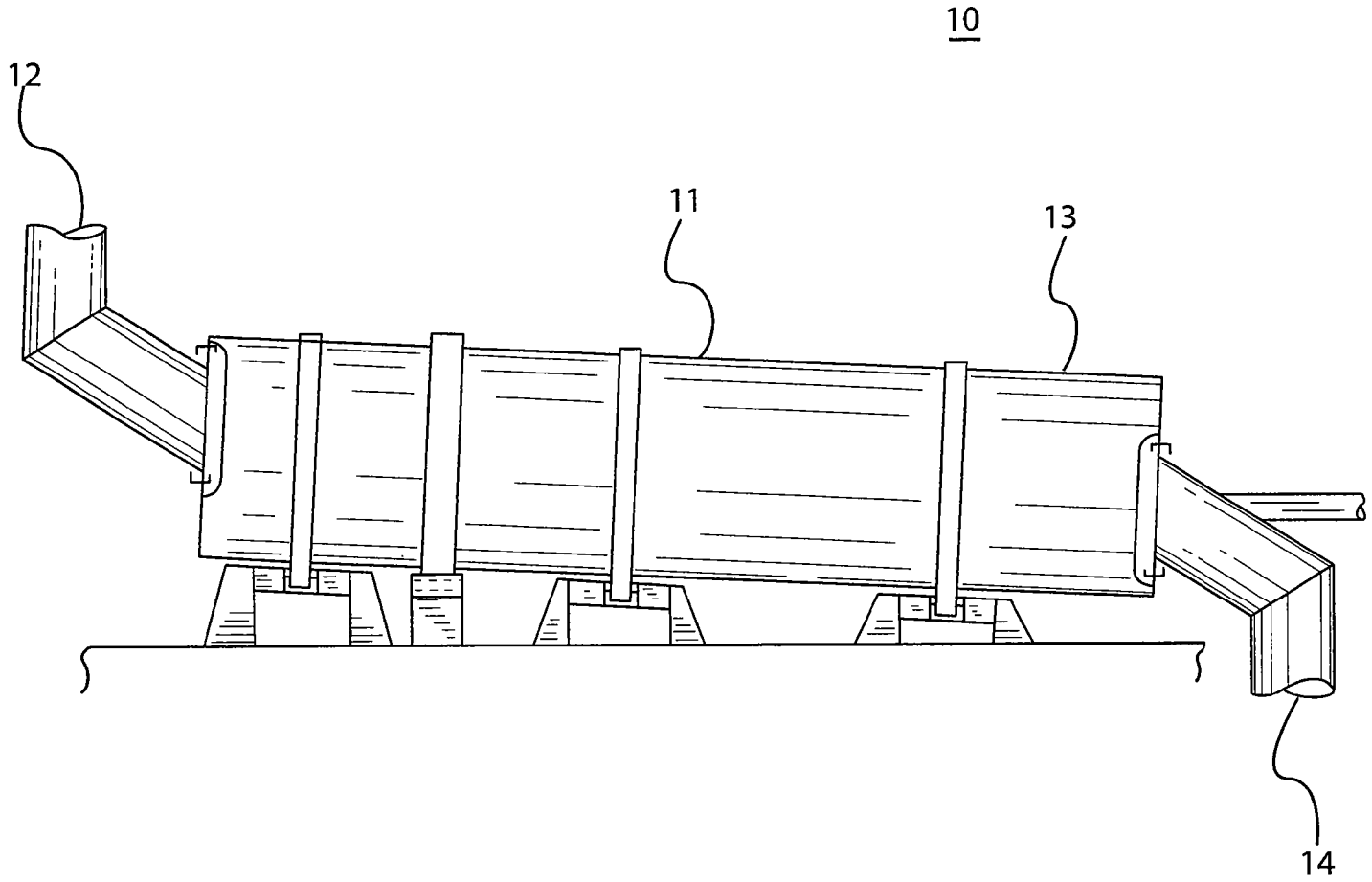
FIG. 1 (Prior Art)
FIG. 1 illustrates a perspective view of a rotary kiln.

Rotary kilns process a wide variety of materials used in a number of industries. FIG. 1 is a perspective view of a rotary kiln 10 according to the prior art. The rotary kiln 10 is characterized by a long cylindrical shell 11 which, when viewed in cross-section (not shown), has a refractory lining which extends longitudinally for a portion or all of the length of the shell 11. Referring back to FIG. 1, shell 11 sits at an incline of 3°-5°, or at an elevation sufficient to cause material charged at an inlet 12 to move towards a discharge 14. Rotary kilns may be constructed in a variety of sizes, with typical diameters of 4-15 feet and lengths of 75-500 feet.

Generally, rotary kilns process materials by heating them to extreme temperatures, as would a furnace. By way of example, the rotary kiln 10 is described below with respect to the pyro-processing of lime. At extreme temperatures, the calcination of limestone to produce Hi-Cal Limestone/quicklime occurs according to the following chemical reaction:

$$CaCO_3+\text{heat}\rightarrow CaO+CO_2$$

Temperatures within the rotary kiln vary by location, but can reach 2700° F. or more in the burning zone portion 13 of the kiln. The burning zone portion 13 is typically located proximate to the discharge 14 of the rotary kiln, and may extend for approximately the last third of the length of the shell 11. In addition to exposing materials to the temperatures described above, the rotary kiln rotates at an adjustable speed, facilitating the transport of the material from the inlet 12 to the discharge 14. The discharge 14 may be in series with a cooler (not shown) such that the material so discharged is immediately cooled.

Within the rotary kiln 10, four discrete factors contribute to the heat transferred to the processing material. First, radiative heat transfer occurs between the hot gases and the material. Second, convective heat transfer occurs between the hot gases and the material. Third, radiative heat transfer occurs between the refractory lining and the material. Finally, conductive heat transfer occurs between the refractory lining and the material. As a general rule, the large majority of heat transfer occurs according to the first and second mechanisms.

Figure 2:
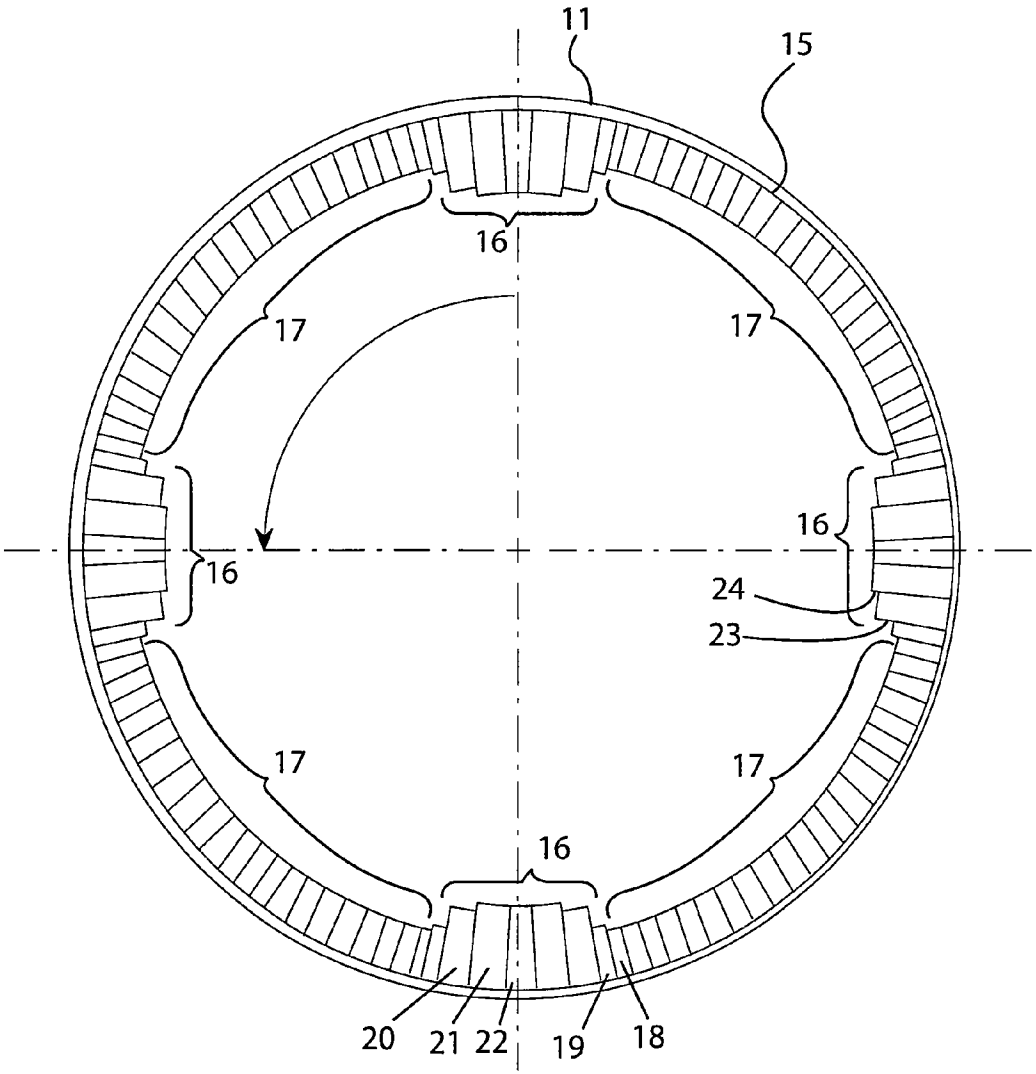
FIG. 2 illustrates a cross-sectional view of the rotary kiln lining according to the present invention.

Turning now to FIG. 2, an exemplary embodiment of the present invention is depicted. Here, the cross-section of the burning zone portion shows the rotary kiln to rotate in a counter-clockwise direction. As the material passes through the burning zone portion, it passes over the refractory lining 15 and is captured by lifter section 16 as the rotary kiln rotates. As the lifter section 16 rotates towards the uppermost point of rotation, the material is released and falls back towards the lowest point of rotation.

The refractory lining 15 is disposed on the inner cylindrical surface of the shell 11, and includes one or more radial portions 17. In the embodiment illustrated, the radial portions 17 are formed by successive placement of refractory bricks 18.

As shown in FIG. 2, refractory lining 15 further includes one or more lifter sections 16 which separate each of the radial portions 17. The refractory bricks 19, which are slightly larger than the refractory bricks 18, provide a transition between the radial portions 17 and the larger lifter sections 16. Refractory bricks 18 and 19 are preferably sized according to the dimensions described by the VDZ or ISO schedules.

The lifter sections 16 are formed of shaped refractory materials employed in steel refining and previously unused in rotary kiln applications. The lifter sections 16 may include a combination of shaped refractory materials, such as shaped refractory materials 20, 21, and 22. Each of the shaped refractory materials 20, 21, and 22 extend orthogonally from the inner cylindrical surface of the shell 11 for a greater portion of the diameter of the shell than the refractory bricks 18 forming the radial portion 17. In the configuration illustrated by FIG. 2, the orthogonal height of the shaped refractory materials 20, 21, and 22 ascends from the outer most shaped refractory materials 20 to the inner most shaped refractory materials 22. The shaped refractory materials 20, 21, and 22 thereby form a series of blunt faces 23 and 24 that define the profile of the lifter sections 16.

At least one, several, or all of the refractory bricks 18 and the shaped refractory materials 20, 21, and 22 are preferably tapered, i.e., these refractory materials have an outside dimension greater than the inner dimension so as to form a keystone effect. This keystone effect generates compressive forces between the radial portions 17 and the lifter sections 16, thereby maintaining the configuration of the kiln lining 15. Other means of affixing the refractory lining 15, however, may also be used.

The refractory bricks 18 and 19 as well as the shaped refractory materials 20, 21, and 22, should have a material composition that exhibits good load and compression resistance, especially under extreme temperatures. For example, materials having a composition such as between about 58 to about 95 percent by weight MgO; between about 1 to about 39 percent by weight CaO; between about 0.5 to about 3 percent by weight $ZrO_2$; between about 0.1 to about 2 percent by weight $SiO_2$; between about 0.1 to about 8 percent by weight $Al_2O_3$; and between about 0 to about 1 percent by weight $Fe_2O_3$ have exhibited sufficient properties for use in the inventive kiln lining.

Figure 3:
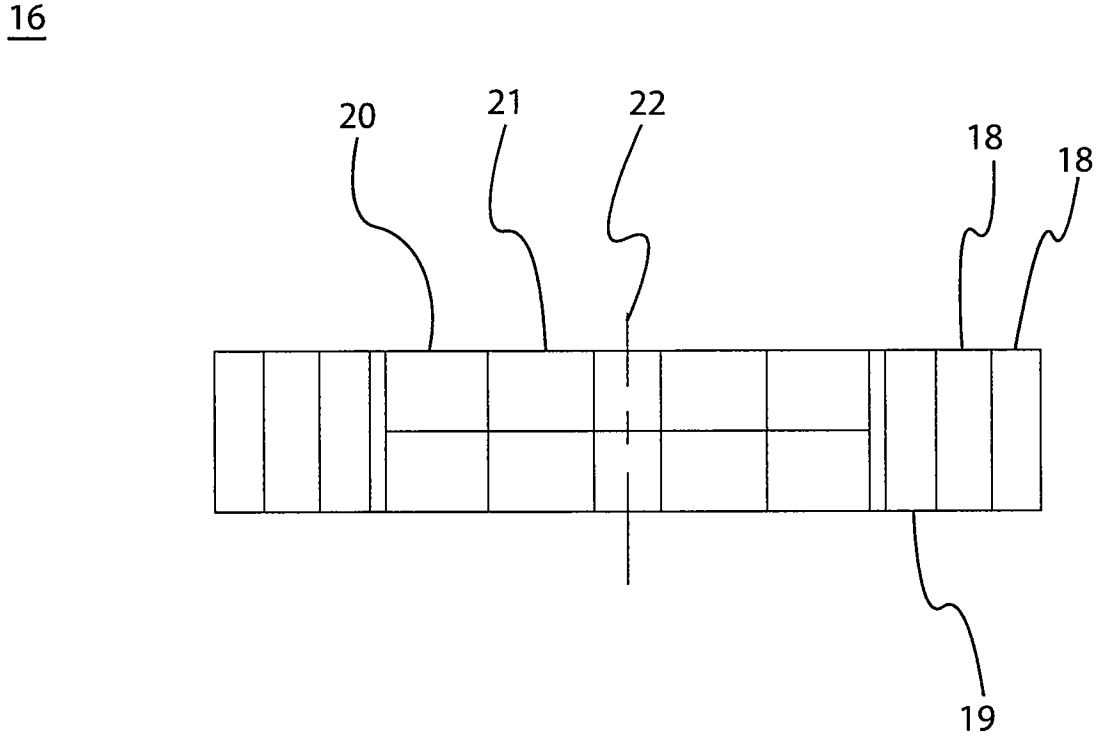
FIG. 3 illustrates a top-down sectional view of one of the lifter sections depicted by FIG. 2.

FIG. 3 illustrates a top-down sectional view of one of the lifter sections 16. From this vantage, refractory bricks 18 and 19 are shown to have a substantially rectangular cross section, while shaped refractory materials 20, 21 and 22 have a substantially square cross section.

Figure 4:
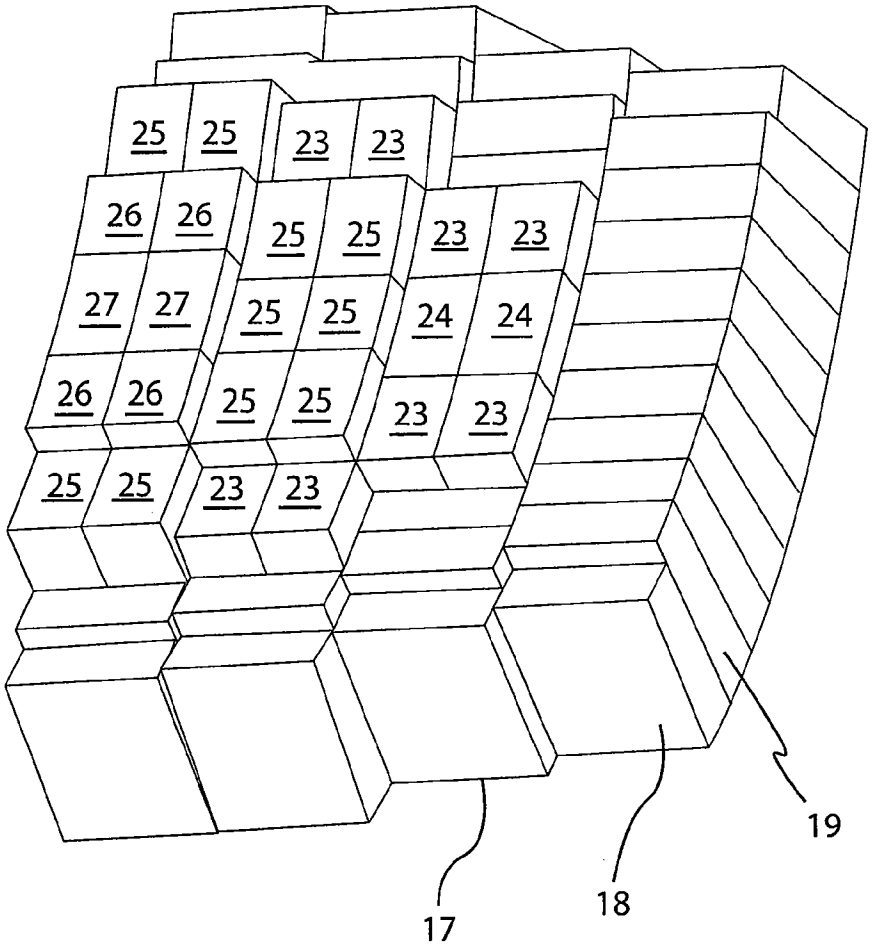
FIG. 4 illustrates a partial view of the gradual transition of one of the lifter sections.

FIG. 4 illustrates a partial view of a gradual transition from one of the radial portions 17 to one of the lifter sections 16. The gradual transition between the orthogonal height of the radial portions 17 and the lifter sections 16 occurs in the longitudinal direction as well as in the circumferential direction. In this particular embodiment, the lifter section 16 is formed of shaped refractory materials 23, 24, 25, 26, and 27, each having different dimensions. This embodiment illustrates that the orthogonal height of shaped refractory materials 23, 24, 25, 26, and 27 increases longitudinally from the outermost shaped refractory materials 23 and 24 to the innermost shaped refractory materials 26 and 27. The orthogonal height of shaped refractory materials 23, 24, 25, 26, and 27 also increases circumferentially from the outermost shaped refractory materials 23 and 25 to the innermost shaped refractory materials 26 and 27. While this specific configuration is disclosed, rotary kilns employing different combinations and sizes of shaped refractory materials will become apparent to those skilled in the art.

Figure 5:
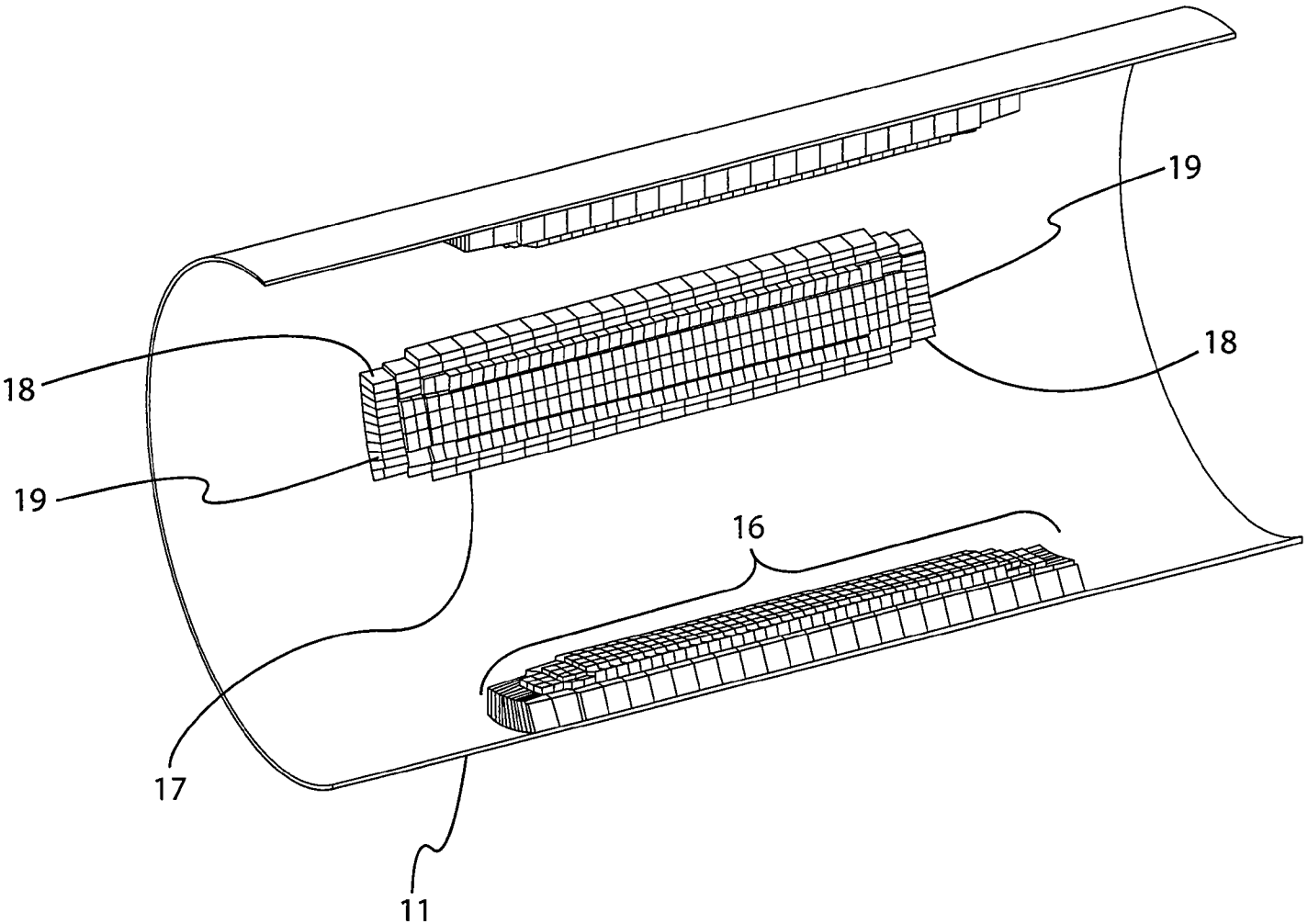
FIG. 5 illustrates a longitudinal view of the rotary kiln lining.

While the burning zone portion 13 should include the lifter sections 16, the entire rotary kiln does not need to as illustrated by FIG. 5. Indeed, other portions of the rotary kiln 10 may have a uniform cross-section comprised entirely of refractory bricks 18. FIG. 5 illustrates a longitudinal view of the inner cylindrical surface of the shell 11. The lifter sections 16 are disposed on the inner cylindrical surface of shell 11 and extend longitudinally for some but not all of the length of the shell 11. The refractory bricks 18, which are shown surrounding the lifter sections 16, have been removed from the remaining surface area of the inner cylindrical surface of shell 11 in order to clearly illustrate the lifter sections 16. It should be understood that the depicted exposed inner cylindrical surface of the shell 11 would, in practice, be fully covered by the refractory bricks 18.

Installation of the inventive kiln lining can be achieved through methods known to those skilled in the art. An exemplary method of installation involves the successive laying of refractory bricks 18 and 19. Upon placement of the shaped refractory materials 20, 21, and 22, wooden pogos are employed to maintain the position of these larger shapes. The wooden pogos are removed upon completion of the cylindrical arrangement, which arrangement produces a compressive force that maintains the position of the lifter sections 16.

The foregoing has described the present invention in but one of its forms. It should be understood that the present invention is not so limited; rather, it is susceptible to various modifications without departing from the illustrated principles.

What is claimed:

1. A rotary kiln comprising:

a cylindrical shell having an inner cylindrical surface and a longitudinal axis a burning zone that extends along the longitudinal axis; and a kiln lining disposed on the inner cylindrical surface of the shell comprising:

one or more radial portions of a first size of shaped refractory material disposed on the inner cylindrical surface of the shell along the longitudinal axis for at least a portion of the shell; and one or more lifter sections comprising a second size of shaped refractory material that extend along the longitudinal axis for at least a portion of the burning zone and are between radial portions of the first size of shaped refractory material, wherein the second size of shaped refractory material is greater than the first size of shaped refractory material, such that the second size of shaped refractory material extends orthogonally from the inner cylindrical surface for a greater portion of the diameter of the shell than the first size of shaped refractory material, the second size of shaped refractory materials thereby forming a series of blunt faces, wherein the one or more lifter sections comprises multiple sizes of shaped refractory material, each greater than the first size of shaped refractory material and arranged in a tiered configuration such that the orthogonal height of the second size of shaped refractory material ascends from the outermost second size of shaped refractory material to the innermost second size of shaped refractory material.

2. The rotary kiln of claim 1 wherein the one or more lifter sections is held under a compressive force by the one or more radial portions.

3. The rotary kiln of claim 1 wherein the one or more lifter sections extend along the longitudinal axis for only the burning zone.

4. The rotary kiln of claim 1 comprising at least two lifter sections.

5. The rotary kiln of claim 1 comprising four lifter sections.

6. The rotary kiln of claim 1 wherein the second size of shaped refractory materials comprise:

between about 58 to about 95 percent by weight MgO;

between about 1 to about 39 percent by weight CaO;

between about 0.5 to about 3 percent by weight $ZrO_2$;

between about 0.1 to about 2 percent by weight $SiO_2$;
between about 0.1 to about 8 percent by weight $Al_2O_3$; and
between about 0 to about 1 percent by weight $Fe_2O_3$.

7. A method of processing materials in a rotary kiln comprising:

feeding material to be processed into a processing zone, wherein the processing zone comprises:

a cylindrical shell having an inner cylindrical surface and a longitudinal axis;

a burning zone that extends along the longitudinal axis;

one or more radial portions of a first size of shaped refractory material disposed on the inner cylindrical surface of the shell along the longitudinal axis for at least a portion of the shell; and one or more lifter sections comprising a second size of shaped refractory material that extends along the longitudinal axis for at least a portion of the burning zone and is between radial portions of the first size of shaped refractory material, wherein the second size of shaped refractory material is greater than the first size of shaped refractory material, such that the second size of shaped refractory material extends orthogonally from the inner cylindrical surface for a greater portion of the diameter of the shell than the first size of shaped refractory material, the second size of shaped refractory materials thereby forming a series of blunt faces, wherein the one or more lifter section comprises multiple sizes of shaped refractory material, each greater than the first size of shaped refractory material and arranged in a tiered configuration such that the orthogonal height of the shaped refractory material ascends from the outermost shaped refractory material to the innermost refractory material; and rotating the processing zone such that the blunt faces lift the material.

8. The method of claim 7 wherein the processing zone comprises more than one lifter sections.

9. The method of claim 7, wherein the one or more lifter sections are held under a compressive force by the one or more radial portions.

10. The method of claim 7, wherein the lifter section comprises:

between about 58 to about 95 percent by weight MgO;
between about 1 to about 39 percent by weight CaO;
between about 0.5 to about 3 percent by weight $ZrO_2$;
between about 0.1 to about 2 percent by weight $SiO_2$;
between about 0.1 to about 8 percent by weight $Al_2O_3$; and
between about 0 to about 1 percent by weight $Fe_2O_3$.

11. A method of constructing a kiln lining for a rotary kiln comprising a cylindrical shell having an inner cylindrical surface and a longitudinal axis, and a burning zone located along the longitudinal axis comprising:

placing one or more radial portions of a first size of shaped refractory material disposed on the inner cylindrical surface of the shell along the longitudinal axis for at least a portion of the shell; and placing one or more lifter sections comprising a second size of shaped refractory material that extends along the longitudinal axis for at least a portion of the burning zone between radial arrangements of the first size of shaped refractory material, wherein the second size of shaped refractory material is greater than the first size of shaped refractory material, such that the second size of shaped refractory material extends orthogonally from the inner cylindrical surface for a greater portion of the diameter of the shell than the first size of shaped refractory materials, the second size of shaped refractory materials thereby forming a series of blunt faces, wherein the one or more lifter sections comprises multiple sizes of shaped refractory material, each greater than the first size of shaped refractory material and arranged in a tiered configuration such that the orthogonal height of the second size of shaped refractory material ascends from the outermost second size of shaped refractory material to the innermost second size of shaped refractory material.

12. The method of claim 11 wherein the kiln lining comprises more than one lifter section.

13. The method of claim 11, wherein the one or more lifter sections are held under a compressive force by the one or more radial portions.

14. The method of claim 11, wherein the second size of shaped refractory material comprises:

between about 58 to about 95 percent by weight MgO;
between about 1 to about 39 percent by weight CaO;
between about 0.5 to about 3 percent by weight $ZrO_2$;
between about 0.1 to about 2 percent by weight $SiO_2$;
between about 0.1 to about 8 percent by weight $Al_2O_3$; and
between about 0 to about 1 percent by weight $Fe_2O_3$.

15. A rotary kiln comprising:

a cylindrical shell having an inner cylindrical surface and a longitudinal axis a burning zone that extends along the longitudinal axis; and a kiln lining disposed on the inner cylindrical surface of the shell comprising:

one or more radial portions of a first size of shaped refractory material disposed on the inner cylindrical surface of the shell along the longitudinal axis for at least a portion of the shell; and one or more lifter sections comprising second and third sizes of shaped refractory material that extend along the longitudinal axis for at least a portion of the burning zone and are between radial portions of the first size of shaped refractory material, wherein the second and third sizes of shaped refractory material are greater than the first size of shaped refractory material, such that the second and third sizes of shaped refractory material extend orthogonally from the inner cylindrical surface for a greater portion of the diameter of the shell than the first size of shaped refractory material, the second and third sizes of shaped refractory materials thereby forming a series of blunt faces, and wherein the second and third sizes of shaped refractory material are arranged in a tiered configuration such that the orthogonal height of the shaped refractory material ascends from the outermost shaped refractory material to the innermost refractory material.

* * * * *